United States Patent [19]

Gallant

[11] Patent Number: 4,483,260

[45] Date of Patent: Nov. 20, 1984

[54] HYDRAULICALLY OPERATED LINEAR ACTUATOR AND AN ELECTRICAL CONTROL SYSTEM

[76] Inventor: Donald A. Gallant, 2611 Danbury St., Charlotte, N.C. 28211

[21] Appl. No.: 297,077

[22] Filed: Aug. 27, 1981

[51] Int. Cl.[3] ..... D05C 15/30

[52] U.S. Cl. ..... 112/79 R; 318/601; 318/604; 307/269; 112/79 A

[58] Field of Search ..... 112/79 R, 79 A; 310/12; 318/567, 600, 601, 602, 604; 307/269

[56] References Cited

U.S. PATENT DOCUMENTS

| | | | |
|---|---|---|---|
| 3,906,324 | 9/1975 | Smith | 318/604 |
| 4,173,192 | 11/1979 | Schmidt et al. | 112/79 R |
| 4,290,000 | 9/1981 | Sun | 318/566 |
| 4,388,884 | 6/1983 | Hirota | 112/121.12 |

*Primary Examiner*—Peter Nerbun

*Attorney, Agent, or Firm*—Richards, Shefte & Pinckney

[57] ABSTRACT

A needle bar shifter for a textile tufting machine having an operating rod connected to the needle bar and extending into an hydraulic cylinder for manipulation by movement of a spool in a bore in the rod, the rod having passages to permit flow of hydraulic fluid from one side to the other of the end of the rod by opening of different passages by movement of the spool, which is manipulated by light hydraulic pressure independent of the high pressure needed for manipulation of the rod and needle bar. An electrical system for controlling manipulation of the spool includes a plug board for predesignating a pattern of individual sequential positions of the needle bar, which positions are indicated by electrical signals generated in response to scanning of the plug board and compared with signals indicating the preexisting position of the spool, with the system limiting the resultant control signal to a preset maximum magnitude so that the rod will be manipulated in steps to the predesignated position, and when no plug is present in a plug row being scanned the system will randomly select a signal to produce a resultant control signal, which is limited as aforesaid in magnitude. A split phase amplifier compares the magnitudes of the resultant control signal and a signal indicating the preexisting position of the spool to produce a polarity indication of the direction of needle bar movement to be effected and permitting individual gain control for each polarity.

37 Claims, 10 Drawing Figures

HYDRAULICALLY OPERATED LINEAR ACTUATOR AND AN ELECTRICAL CONTROL SYSTEM

BACKGROUND OF THE INVENTION

The present invention is directed to an hydraulically operated linear actuator and an electrical control system, and more particularly in its preferred form to a hydraulically operated needle bar shifter for a textile tufting machine and an electrical control system for generating control signals for commanding stepwise positioning of the needle bar, including a split phase amplifier that provides independent gain control of opposite polarity signals that produce opposite directional movement of the needle bar.

Prior art hydraulically operated linear actuators take various forms, usually having an operating rod that is reciprocated by hydraulic forces directly controlled by some type of control valve. Typically, the control valve is a servo valve that controls the direct application of the hydraulic fluid to the rod, providing positive control with relatively smooth acceleration and deceleration. However, with the servo valve normally controlling the operating hydraulic fluid directly, the size and capacity of the servo valve must be capable of controlling the pressures and flows necessary to manipulate the rod under load and with heavy duty actuators a heavy duty servo valve would be necessary with attendant relatively slower response and lesser sensitivity than is possible with low energy servo valves. In contrast, the present invention provides an indirect control of the hydraulic manipulation in which a light duty servo valve can be used with sensitive control and fast response at low energy and pressure to manipulate a rod under high energy and pressure for manipulation of a relatively heavy load.

Prior art electrical control systems of the type used to control positioning of loads as by control of a linear actuator, commonly provide control signals to manipulate a load to a preselected position that must be or inherently is within the manipulating limits of the actuator or other device being operated and that is capable of providing a repeating pattern of manipulation. By the present invention the electrical control system is capable of limiting the increment of movement within a predetermined magnitude range short of a preselected position that may be outside the predetermined range, with the subsequential incremental movements progressing toward the preselected position until the position is reached, and it further provides for a random selection of a position to which the load is moved when no position has been preselected.

Further, in many reciprocating devices, such as linear actuators, the resistance to movement in one direction is not necessarily the same as in the opposite direction so that applying the same actuating force in both directions will result in non-uniform response time and sensitivity, which may be disadvantageous as, for example, in using the actuator to shift the needle bar of a textile tufting machine laterally in the limited time available during the portion of each tufting cycle when the needles are withdrawn from the fabric being tufted. By the present invention, a split phase amplifier is used in the electrical control system to compare the magnitude of the resultant control signal with the magnitude of a signal indicating that preexisting position of the device, and imposing a polarity on the difference depending on which signal is greater, with the polarity determining the direction of movement responsive to the control signal; and separate gain controls are provided for each polarity to allow independent adjustment of the excitation level, thereby providing the capability of offsetting differences in resistance to movement in opposite directions so that uniform equally responsive movement is obtained in both directions.

In the preferred embodiment, the present invention is in the form of an electrohydraulic linear actuator for transversely shifting the needle bar of a multiple-needle textile tufting machine. There are two primary purposes for incorporating a mechanism to obtain needle bar shifting. One is the obvious purpose of producing patterns in the tufted product and the other is to minimize streaking of color shades that can result from different dye affinity of yarns when the product is dyed after tufting. To reduce inventory requirements, many tufted products which are intended to be of a single color are tufted with undyed yarn and later dyed in a selected single color as orders are received. When this is done, some of the multitude of yarn ends that are creeled for a run of a tufted product may not accept the dye equally, which is not apparent until after the product is finished. If the product is "straight stitched", streaks may be visible which make the product less acceptable. It is known to minimize this problem by breaking up the straight line stitches by transversely shifting either the needle bar or the backing fabric to produce a zig-zag pattern.

In the past, needle bar shifting has been accomplished by mechanical devices or by an electrohydraulic apparatus, such as shown for example in Schmidt et al U.S. Pat. No. 4,173,192. Such needle bar shifting in the prior art has been limited by the distance, in increments of needle gauge, over which the needle bar may be shifted in each step and by the time required to make the shift, which limit the speed at which the tufting machine may be operated to allow the necessary shifting. Further, the needle bar may, of course, be shifted only during that portion of the stitch period during which the needles are out of the backing of the product that is being tufted. This portion of the stitch period is determined principally by the total reciprocated travel distance of the needles, and by the depth of penetration of the needles into the backing material, and may be a minor fraction of the total stitch period. To function properly, the mass of the needle bar must be accelerated from zero transverse velocity to some maximum and then decelerated to zero velocity at a closely defined position all within this fraction of the stitch period. The average velocity required to shift the mass of the needle bar increases linearly with both the stitch rate and the length of shift, with the energy of motion of the mass increasing with the square of the velocity and hence with both the square of the stitch rate and the square of the shift length. Therefore, prior attempts to increase either the stitch rate or shift length have required increasingly larger cylinder areas and fluid flow rates, and when a servo valve is used, the size and the fluid pressures required may be beyond accepted commercial practice. In particular, large servo valves inherently have a longer response time than smaller valves and practical limits in the stitch rate and shift length restrict the speed at which shifting can be accomplished, which correspondingly restricts the rate at which the tufting machine can operate.

The aforementioned Schmidt U.S. Pat. No. 4,173,192 typifies the limitations of the prior art in that the electrohydraulic apparatus of that patent utilizes the servo valve directly to manipulate the operating rod to which the needle bar shifting mechanism is secured, thus requiring a servo valve of sufficient pressure and volume capability to directly manipulate the needle bar with the aforementioned resultant speed and sensitivity limitations. In the Schmidt patent a conventional closed loop control system is utilized having a feedback loop that is closed by a linear variable differential transformer, the core of which is attached directly to the operating rod to supply a feed back signal. This position signal is summed with a position command signal taken from a pattern program stored in a programmable read only memory (PROM) as a binary number that is decoded by a multiplying digital-to-analog convertor whose reference voltage is derived from the same signal that drives the aforementioned transformer. The difference between the feedback signal and the command signal is then demodulated and conditioned to a value necessary to drive the servo valve, as is familiar to those skilled in the electrohydraulic servo valve art.

In the electrohydraulic needle bar shifter form of the present invention the servo valve is independent of the operating rod manipulating hydraulics so that a high speed, sensitive response, low pressure and volume servo valve can be utilized with resulting high speed and sensitive operation of the shifter. As a result of the fast operating characteristic of the present invention, it is possible to provide a wide range of movement capability not possible with the prior art, and in this regard the system incorporates means for limiting the magnitude of movements to a selected range and also provides for random position selecting, neither of which capabilities are included in the Schmidt patent or other known prior art. In addition, the prior art does not disclose independent gain control adjustment for excitation of the servo valve in opposite directions for balancing of differences in resistance to movement in the opposite direction so that uniformity of movement is obtained.

SUMMARY OF THE INVENTION

Briefly described, the hydraulically operated linear actuator of the present invention includes an operating rod that reciprocates in a piston chamber and extends through a return chamber with pressurized hydraulic fluid being introduced into the piston chamber and being discharged from the return chamber. The operating rod has a linearly extending bore opening into the piston chamber and in which bore a control spool is slidably disposed for simultaneous closing or individual opening of spaced passages for flow of hydraulic fluid from one side of the piston end of the operating rod to the other and for flow of fluid to the return chamber. Upon movement of the spool from a disposition closing both passages to a position opening one or the other of the passages, the fluid flow through the opened passage will cause movement of the operating rod in a direction to shift the operating rod until it has moved to a position in which the spool closes the passages. In the preferred embodiment, the spool is disposed so that slight movement in one direction or the other will open one or the other of the passages and the ends of the spool are tapered adjacent the passageways to provide gradual reduction in the flow passage at the end of movement of the operating rod, thereby causing gradual decelerating relative movement of the operating rod as it approaches a position in which both passages are closed. Preferably, the effective surface area of the control spool is balanced within the piston chamber so that it is substantially unaffected by the pressure of the hydraulic fluid, and the spool extends from the piston chamber for manipulation by spool postioning means exteriorly of the chamber, which spool positioning means preferably is a hydraulic system such as a servo valve. Means are provided for selecting a position toward which the spool is to move, with the extent of movement being limited to a predetermined distance from its previous position, with the selection of the position remaining inactive until the spool has made sufficient movements to have moved to the selected position, which selected position may be randomly selected.

The electrical control system of the present invention includes means for generating a series of electrical signals providing different magnitude indications proportional to stepwise positions of an object being positioned by the control system. A signal from the series is selected by selecting means, and means compare the magnitude indicated by the selected signal with a magnitude proportional to the pre-existing position of the object to determine the difference between the magnitudes. Means then compare the magnitude difference with a preset maximum magnitude difference, and means utilizes the lesser of said differences to select, respectively, either the selected signal or the preexisting signal combined with the preset magnitude difference to produce a resultant control signal to which means respond to position an object in proportion to the magnitude of the resultant control signal as limited. Means are also provided responsive to the magnitude indicated by the selected signal being different from the magnitude of the resultant control signal to interrupt the signal selecting means and thereby maintain the selected signal for processing in the control system as the next selected signal. Preferably, the signal magnitude comparing means determines the absolute value of the magnitude difference and whether the magnitude of the selected signal is greater or lesser than the magnitude of the preexisting control signal and the aforementioned magnitude difference utilizing means combines the preset maximum as addition or subtraction to the preexisting control signal. Preferably, the signal generating means produces a plurality of series of signals to be selected and cycling means are provided to activate the signal generating means to index to a next series of signals in response to the magnitude of the selected signal being the same as the magnitude of the resultant control signal, which results in the selected signal being maintained until the system has incrementally advanced to produce a resultant control signal that is the same as the selected signal.

According to another feature of the control system of the present invention, the signal generating means includes means for scanning a series of signals and means for periodically cycling the system to actuate release of a scanned signal by a signal receiving and releasing means with the period of cycling actuation of the signal receiving and releasing means being sufficiently imprecise in relation to the frequency of scanning to vary over a range greater than a plurality of periods of the scanning frequency whereby the scanned signal at the signal receiving and releasing means at the instant of actuation to release a signal is an unpredictably randomly selected signal. Thus, when no signal has been predesignated in a series of signals being scanned, a random selection occurs, which, in the preferred embodiment, is combined with the magnitude limiting feature previously discussed.

A further feature of the electrical control system of the present invention is the inclusion of a split phase amplifier that includes means for inverting the polarity of one of two direct current input signals of the same polarity and producing an intermediate signal proportional to the difference between the magnitudes of the two input signals with a polarity determined by which of the two input signals is of greater magnitude. Positive and negative polarity gain control means are provided for conducting only positive and negative, respectively, intermediate signals and independently adjusting the magnitude thereof, and means are provided for receiving the independently adjusted magnitude intermediate signal and providing an output signal therefrom, thereby allowing adjustment of excitation levels of the signals of opposite polarity.

DESCRIPTION OF THE PREFERRED EMBODIMENTS

Figure 1:
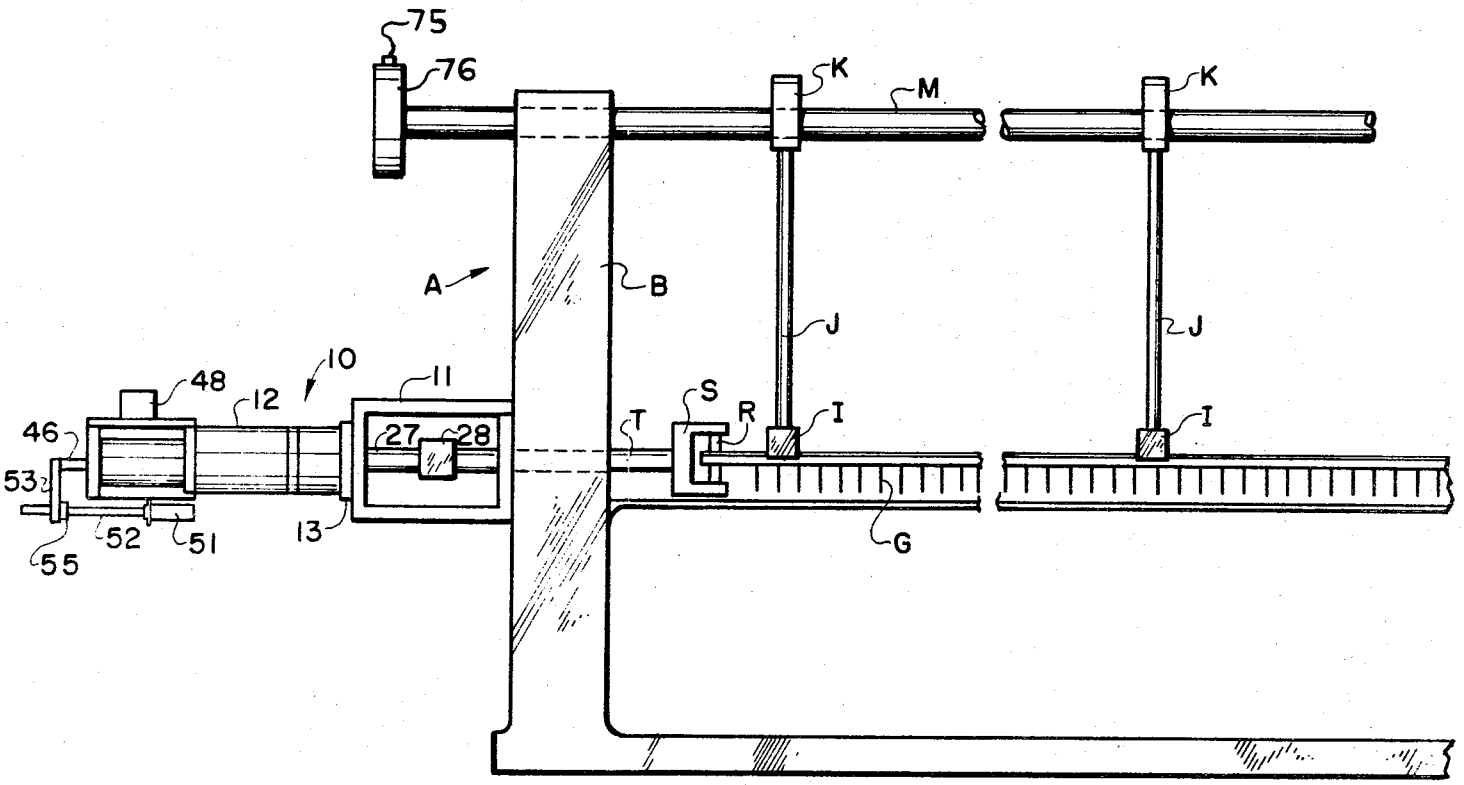
FIG. 1 is a schematic rear elevation of a portion of a carpet tufting machine having incorporated therein the electrohydraulic needle bar shifter with electrical control system according to the preferred embodiment of the present invention.
Figure 2:
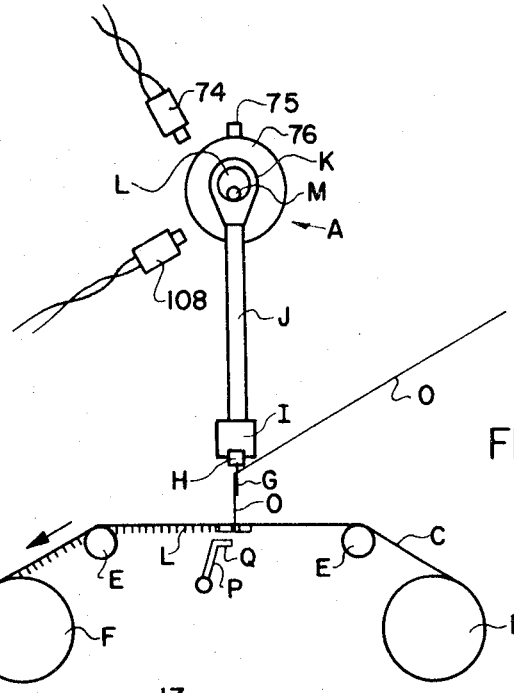
FIG. 2 is a schematic side elevation of a portion of the machine of FIG. 1.

The hydraulically operated linear actuator and electrical control system of the present invention is illustrated in the accompanying drawings and disclosed hereinafter in the preferred embodiment incorporated in an electrohydraulic needle bar shifter for a textile carpet tufting machine. As seen in FIGS. 1 and 2, the machine A includes a frame B that supports a carpet fabric backing C for feeding from a feed roll D over support rolls E onto a take-up roll F, with the backing C advancing under a plurality of tufting needles G depending from a needle bar H in a row extending transversely with respect to the machine A. The needle bar H is slidably supported in spaced mountings I attached to the lower ends of vertical connecting rods J suspended from bearings K that are mounted on eccentrics L on a rotating drive shaft M, rotation of which causes, through the eccentrics L vertical reciprocation of the needle bar H to insert the needles G into the fabric to insert loops N of tufting yarn, which loops N are engaged by loopers P to hold the loops N as the needles G are retracted and may have cutting blades Q to cut the loops N into lengths of cut pile as the fabric C advances. One end of the needle bar H projects beyond the row of needles G and is connected for free vertical movement on a pin R of a yoke S fixed to the end of a transversely extending shifting rod T that extends through the frame B for manipulation transversely to effect transverse shifting of the needle bar H, thereby shifting the needles for insertion of the yarn in different needle rows as selected by a pattern mechanism that controls operation of the shifting rod T. The components of the tufting machine A as described up to this point are conventional and details are not included in this disclosure as anyone skilled in the art is familiar with the construction and operation of such machines. It is to such a machine that the preferred embodiment of the present invention is adapted.

The shifter 10 of the preferred embodiment is mounted on a subframe 11 secured to the end of the frame B for support of the shifter 10 exteriorly on the frame B in cantilever projection transversely in alignment with the needle bar H and attached shifting rod T therefor. The shifter 10 includes a generally cylindrical housing 12 having a mounting plate 13 secured to the subframe 11 and supporting an inner housing portion 14 that encloses a return chamber 15. An inner plate 16 is mounted on the outer end of the inner housing portion 14 and supports an intermediate housing portion 17, with the assembly of the mounting plate 13, inner housing portion 14, inner plate 16 and intermediate housing portion 17 being secured together by a plurality of attaching bolts 18 that have their heads seated in the mounting plate 3 and their threaded ends tightened into the intermediate housing portion 17. At the outer end of the intermediate housing portion 17 an outer plate 19 is secured by a plurality of bolts 20, with the inner plate 16, intermediate housing portion 17 and outer plate 19, enclosing a linearly extending piston chamber 21. Secured by bolts 22 to the outer plate 19 is a reduced size outer housing portion 23, to the outer end of which is secured by bolts 24 an end plate 25, with the outer plate 19, outer housing portion 23 and end plate 25 enclosing a spool positioning chamber 26.

Projecting axially from the housing 12 into the subframe 11 in alignment with the shifting rod T is an operating rod 27 that is secured to the shifting rod T by a threaded coupling 28. This operating rod 27 is reciprocally mounted in the housing 12 and extends inwardly thereof through the return chamber 15 and into the piston chamber 21, in which the end of the operating rod is formed to provide a double-acting piston 29 intermediate the ends of the piston chamber 21 to divide the piston chamber into a portion 30 into which an intake port 31 opens and a portion 32 opposite the intake port 31. The operating rod 27 is formed with a linearly extending axial bore 33 extending centrally from the piston 29 at which the bore 33 opens into the opposite portion 32 of the piston chamber 21 through the piston chamber 21 and into the return chamber 15 at which location the operating rod 27 is formed with radial holes communicating between the axial bore 33 and the return chamber 15.

The operating rod 27 is formed with a plurality of drive passages 35 communicating between the intake port portion 30 of the piston chamber 21 and the bore 33 of the operating rod 27. These drive passages 35 extend at an inclination from the outer surface of the operating rod 27 adjacent the intake port facing surface of the piston 29 toward the opposite portion 32 of the piston chamber 21 and open into an annular recess 36 in the bore 33, which recess 36 forms an opening for the drive passages 35. When there is no obstruction in the axial bore 33, pressurized hydraulic fluid supplied from a conventional source through the intake port 31 into the intake port portion 30 of the piston chamber 21 will flow through the drive passages 35 into the opposite portion 32 of the piston chamber 21 and apply a driving force to the surface of the operating rod piston 29 facing into the opposite portion 32 of the piston chamber 21.

The operating rod 27 is also provided with a plurality of return passages 37 that open in the surface of the operating rod piston 29 facing into the opposite portion 32 of the piston chamber 21 and extend generally longitudinally through the operating rod 27 to an annular recess 38 formed in the bore 33 at a substantial spacing inwardly within the bore 33 from the annular recess 36 for the drive passages 35. This annular recess 38 for the return passages 37 forms an opening for the return passages 37 into the bore 33 to allow, when the annular recess 38 is not obstructed, return flow of hydraulic fluid from the opposite portion 32 of the piston chamber 21 through the inner end of the bore 33 and through the radial holes 34 into the return chamber 15 for passage through a discharge port 39 for return to a sump.

A cylindrical control spool 40 is sealingly disposed in the bore 33 for sliding therein and has an effective sealing length within the bore 33 equal to, and particularly not less than, the space between the fartherest apart edges of the drive passage annular recess 36 and return passage annular recess 38 so that the spool 40 can be disposed in covering relation to both recesses and upon only slight linear or axial movement of the control spool 40, one or the other of the recesses 36 and 38 will open into the bore 33.

Figure 7:
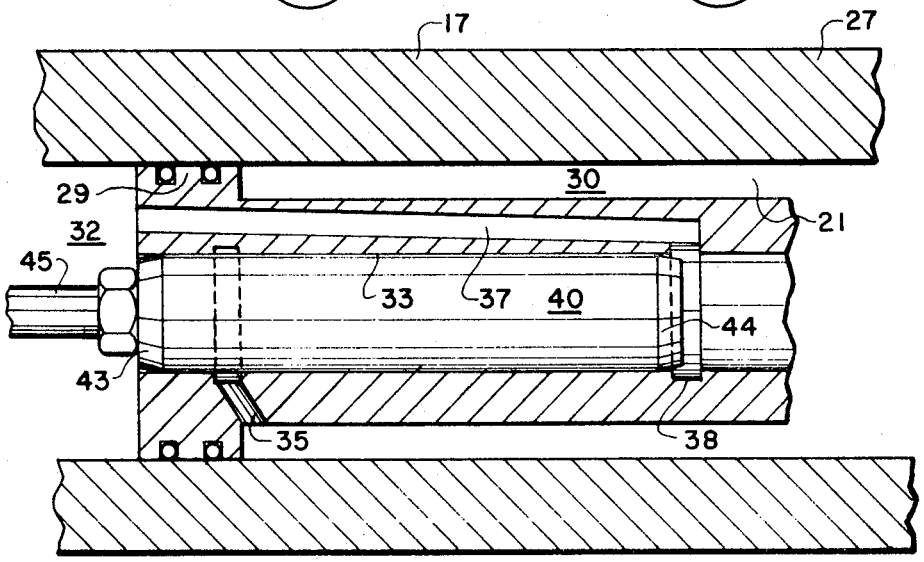
FIG. 7 is a view similar to FIG. 6, but with the spool displaced to the left within the bore of the operating rod.
Figure 3:
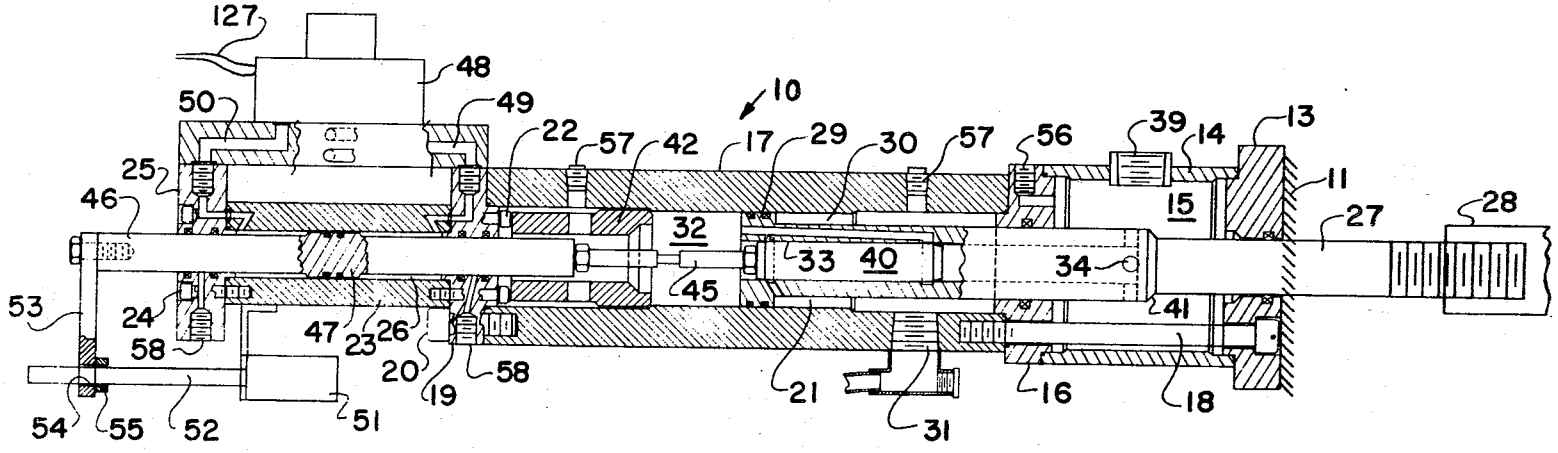
FIG. 3 is a vertical sectional view through the axis of the needle bar shifter of FIG. 1.
Figure 4A:
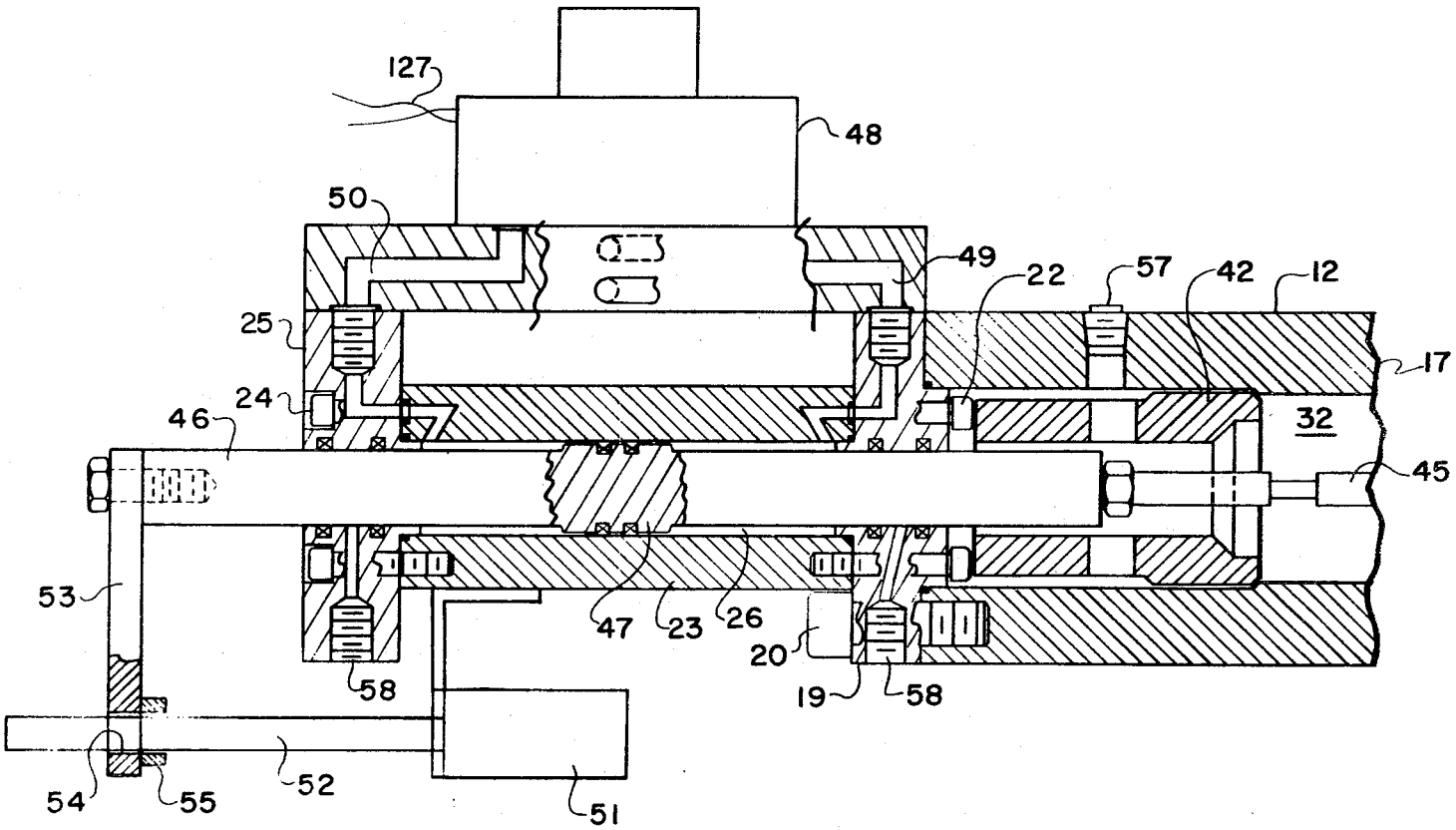
FIG. 4A is an enlargement of the left hand portion of the shifter of FIG. 3.
Figure 4B:
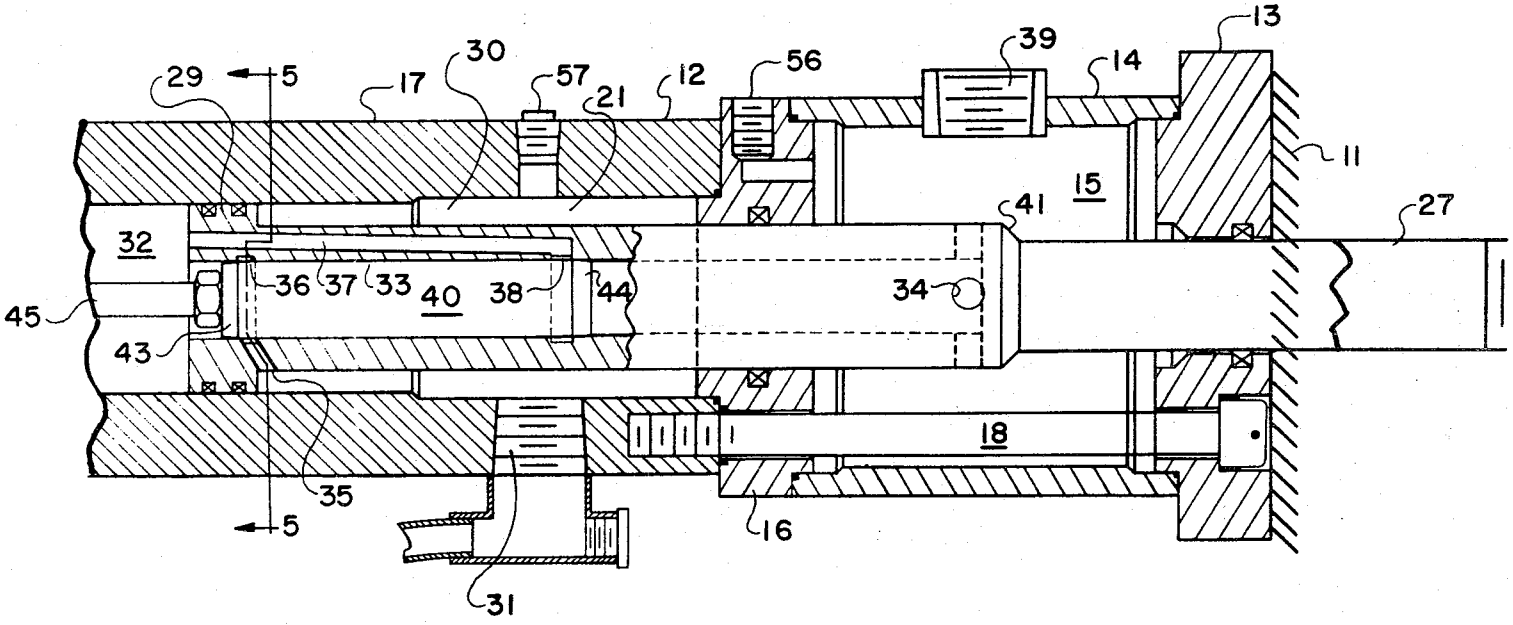
FIG. 4B is an enlargement of the right hand portion of the shifter of FIG. 3.
Figure 5:
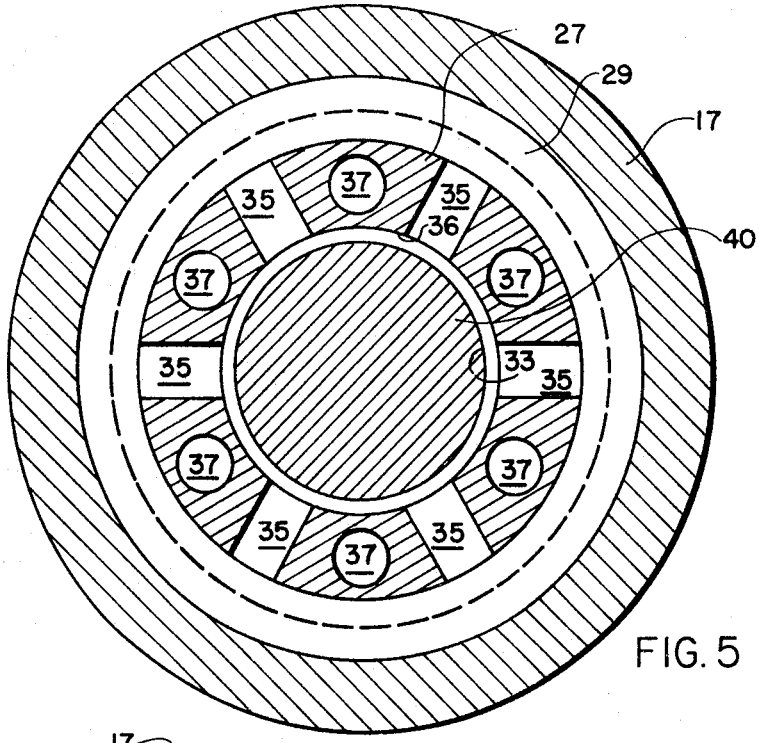
FIG. 5 is a vertical sectional view taken along line 5—5 of FIG. 4B.
Figure 6:
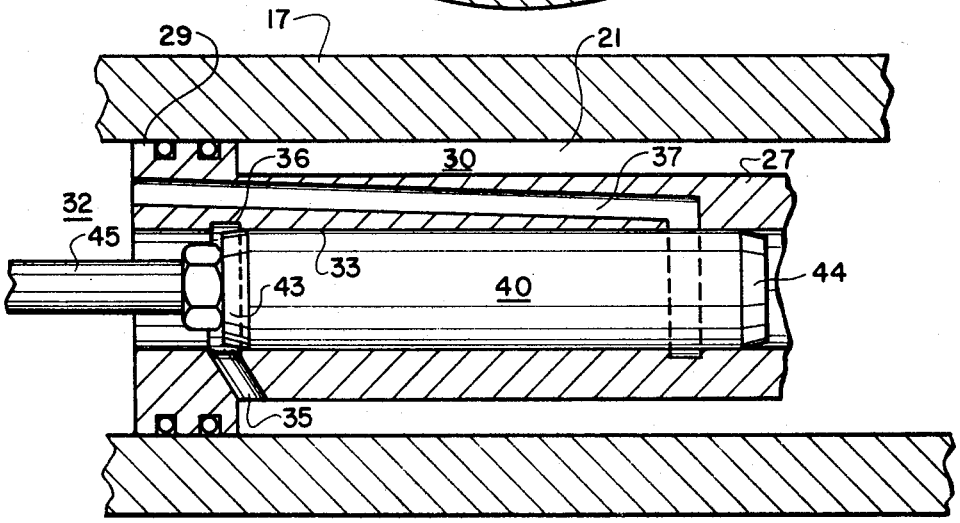
FIG. 6 is a further enlargement of a portion of the shifter as illustrated in FIG. 3 with the spool displaced to the right within the bore of the operating rod.

With this arrangement of the control spool 40, drive passages 35, return passages 37 and bore 33 the initial introduction of pressurized hydraulic fluid through the intake port 31 into the intake port portion 30 of the piston chamber 21 will cause pressure to be applied to the surface of the piston 29 facing the intake port portion 30, which will force the piston 29 and operating rod 27 to the left as shown in the drawings or away from the machine A, which will move the drive passage annular recess 36 outwardly away from the covering relation of the control spool 40 so that the pressurized hydraulic fluid will flow into the opposite portion 32 of the piston chamber 21 and act against the facing portion of the piston 29. The effective surface area of the piston 29 in the opposite portion 32 of the piston chamber 21 is sufficiently larger than the effective surface area of the piston 29 in the intake port portion 30 of the piston chamber 21 so that the pressurized hydraulic fluid when equally disposed in both portions of the piston chamber 21 will cause the piston 29 and operating rod 27 to move to the right or toward the machine A until the drive passage annular recess 36 is again in closing relation on the control spool 40. Upon this closure of the drive passage annular recess 36, no further pressurized fluid can flow into the opposite portion 32 of the piston chamber 31 and movement of the piston 29 will, therefore, stop. Once this equalibrum position is established, the piston will remain in this position so long as the control spool 40 remains in its original position. However, upon movement of the spool to the left or away from the machine A (FIG. 7), the return passage annular recess 38 will be exposed to the bore 33 allowing the fluid in the opposite portion 32 of the piston chamber 21 to flow through the return passages 37 into the return chamber 15 under the pressure of the fluid acting on the surface of the piston 29 in the intake port portion 30 of the piston chamber 21, which force causes a contraction of the opposite portion 32 of the piston chamber 21 with an accompanying movement of the piston 29 and operating rod 27 to the left or away from the machine A until the return passage annular recess 38 is again in covering relation to the control spool 40 so that further return flow of fluid from the opposite portion 32 of the piston chamber 21 will not occur and, therefore, movement of the piston 29 and operating rod 27 will stop. During this manipulation, the drive passage annular recess 36 remains closed by the control spool 40 so that pressurized fluid does not flow from the intake port portion 30 to the opposite portion 32 of the piston chamber 21. Upon manipulation of the control spool 40 from the position of equalibrum to the right or toward the machine A (FIG. 6), the drive passage annular recess 36 will be exposed to the bore, thereby opening the drive passages 35 to permit flow of pressurized fluid into the opposite portion 32 of the piston chamber 21 to cause the fluid acting against the effective surface area of the piston in the opposite portion 32 to cause the piston 29 and operating rod 27 to move to the right or toward the machine A against the lesser force resulting from the pressurized fluid acting on the smaller effective surface area of the piston in the intake port portion 30. This movement continues, expanding the opposite portion 32 of the piston chamber 21 and moving the piston 29 and operating rod 27 to the right or toward the machine A until the drive passage annular recess 36 is again positioned in closing relation to the control spool 40, at which further movement of the piston 29 and operating rod 27 will stop. During this manipulation the control spool 40 has remained in closing relation to the return passage annular recess 38 so that fluid in the opposite portion 32 of the piston chamber 21 cannot flow into the return chamber 15.

With the above-described construction, assembly and operation, movement of the control spool 40 is followed precisely by movement of the operating rod 27 with the spool 40 being independent of an unrestricted by the high pressure and flow requirements to move the operating rod, and the tolerances between the length of the spool 40 and the spacing of the drive passage recess 36 and return passage recess 38 can be maintained sufficiently close to affect substantially precisely identical movement of the operating rod 27 in following relation to the control spool 40. The spacing between the annular recesses 36 and 38 and the corresponding length of the control spool 40 is sufficient to permit movement of the spool 40 a maximum distance equivalent to the maximum number of needle spacings that the shifter is designed to manipulate the needle bar H, without the spool 40 moving in either direction both annular recesses 36 and 38, thus maintaining a portion of the control spool 40 between the recesses at all times so that there will be no communication therebetween, which would render the shifter 10 inoperative. Movement of the operating rod 27 is also physically restricted in this regard by having an inner shoulder 41 in the return chamber 15 capable of abutting the mounting plate 13 to stop movement of the operating rod 27 to the right or toward the machine A and by a spacer block 42 positioned in the left or outward end of the piston chamber 21 for abutment thereagainst by the piston 29 in an extreme leftward position away from the machine A. The linear space between the piston 29 and the inner shoulder 41 is sufficiently less than the space between the spacer block 42 and mounting plate 13 to permit normal reciprocation of the operating rod 27 while preventing excessive movement that would produce a non-operating positioning of the operating rod 27 with respect to the spool 40.

The spool 40 extends beyond the annular recesses 36 and 38 when the spool is in recess closing position at a slight inward taper, as shown at 43 and 44. This taper provides a somewhat gradual closing of the recesses as the operating rod 27 approaches a closing position in its spool following movement. This gradual closing causes gradual decelerating relative movement of the operating rod with respect to the spool as it approaches a position in which both passages are closed, thereby minimizing undesirable abrupt stopping action.

The control spool 40 has a connecting portion 45 of reduced diameter extending within the opposite portion 32 of the piston chamber 21 to an enlarged operating portion 46 of substantially the same diameter as the portion of the spool 40 within the operating rod bore 33, and the operating portion 46 extends out of the piston chamber 21 and through the spool positioning chamber 26 and therebeyond exteriorly of the housing 12. With this arrangement, the effective surface area of the spool 40 within the opposite portion 32 of the piston chamber 21 is substantially balanced so that the spool is substantially unaffected by the pressure of the hydraulic fluid in the opposite portion 32 and can be manipulated without restriction by the fluid pressure.

The operating portion 46 of the spool 40 is formed with a piston portion 47 within and intermediate the ends of the spool positioning chamber 26 so that fluid can be introduced under pressure to either side of the spool positioning chamber 26 to act on the piston portion 47 and cause manipulation of the spool 40. The application of fluid under pressure to one side of the piston portion 47 and discharge of fluid from the opposite side to effect manipulation is controlled by a servo valve 48 of conventional construction, such as a commercially available Model 131 Pegasus servo valve marketed by Koehring. This servo valve is mounted on the outer plate 19 and end plate 25 above the outer housing portion 23 and communicates with the right end of the spool positioning chamber 26 to a passage 49 through the outer plate 19 and outer housing portion 23, and communicates with the left end of the spool positioning chamber 26 through a passage 50 extending through the end plate 25 and outer housing portion 23. As the spool is hydraulically balanced within the piston chamber 21 and is not restricted by the high operating pressures of the fluid necessary to manipulate the operating rod 27, a low energy level servo valve with low pressure and flow characteristics that provide fast operation and sensitive response can be used to manipulate the spool.

The servo valve 48 is excited by an electrical control system to be described hereinbelow, which compares a signal corresponding to a desired spool position with the actual position of the spool to provide a resultant control signal to the servo valve 48. The sensing of the position of the spool 40 is accomplished by a conventional ultrasonic position transducer 51 mounted exteriorly on the housing 12 and having a sensing rod 52 extending parallel to and beneath the spool 40 an extent sufficient to be below the outer end of the spool 40 in all operating positions of the spool. The spool 40 has an arm 53 depending from its outer end to the sensing rod 52, with the lower end of the arm 53 having a hole 54 for sliding on the sensing rod 52 and carrying an annular magnet 55 that also slides on the sensing rod 52, with the transducer 51 being responsive to the position of the magnet 55 along the sensing rod 52 to provide a signal corresponding to the spool position. This sensing of the spool position to obtain a feedback signal provides faster response to positioning than would be the case if the feedback signal is responsive to the position of the operating rod 27, as the operating rod follows movement of the spool and inherently involves slight delay that could produce over positioning and chattering at the end of movements, particularly if there is significant resistance to movement of the operating rod that results in sluggish operation. This differs from a feedback signal as developed in the device of the aforementioned Schmidt U.S. Pat. No. 4,173,192, where there is no spool arrangement and the operating rod is directly manipulated by the servo valve, with the feedback being responsive to the operating rod itself. Thus, the feedback in the shifter 10 of the present invention is internally responsive whereas that in the device of the Schmidt patent is externally responsive.

For completeness, the shifter 10 shown in the drawings includes conventional seals mounted in the mounting plate 13, inner plate 16, outer plate 19, and end plate 25 in engagement with the operating rod 27 and spool 40 to sealingly separate the adjacent chamber and the exterior, and similar seals are mounted in the operating rod piston 29 and spool piston 47 to sealingly separate the opposite portions of the piston chamber 21 and spool positioning chamber 26, respectively. Opening into the return chamber 15 is a dump port 56 that may be connected by conventional valving to the high pressure line to return overflow of the fluid in the high pressure line through the return chamber 15 and discharge port 39 to the sump. The return from the servo valve 48 can also be conveniently connected to this dump port 56. Plugged air vent ports 57 are provided in the intermediate housing portion 17 communicating with the piston chamber 21 to allow air to vent out during filling operation and being plugged during normal operation, with the air vent port 57 in the intake port portion 30 of the piston chamber 21 being capable of connection to the intake of the servo valve 48 to provide pressurized hydraulic fluid thereto. Bleed ports 58 are formed in the outer plate 19 and end plate 25 to bleed off any fluid that may leak between the seals in these plates.

Figure 8:
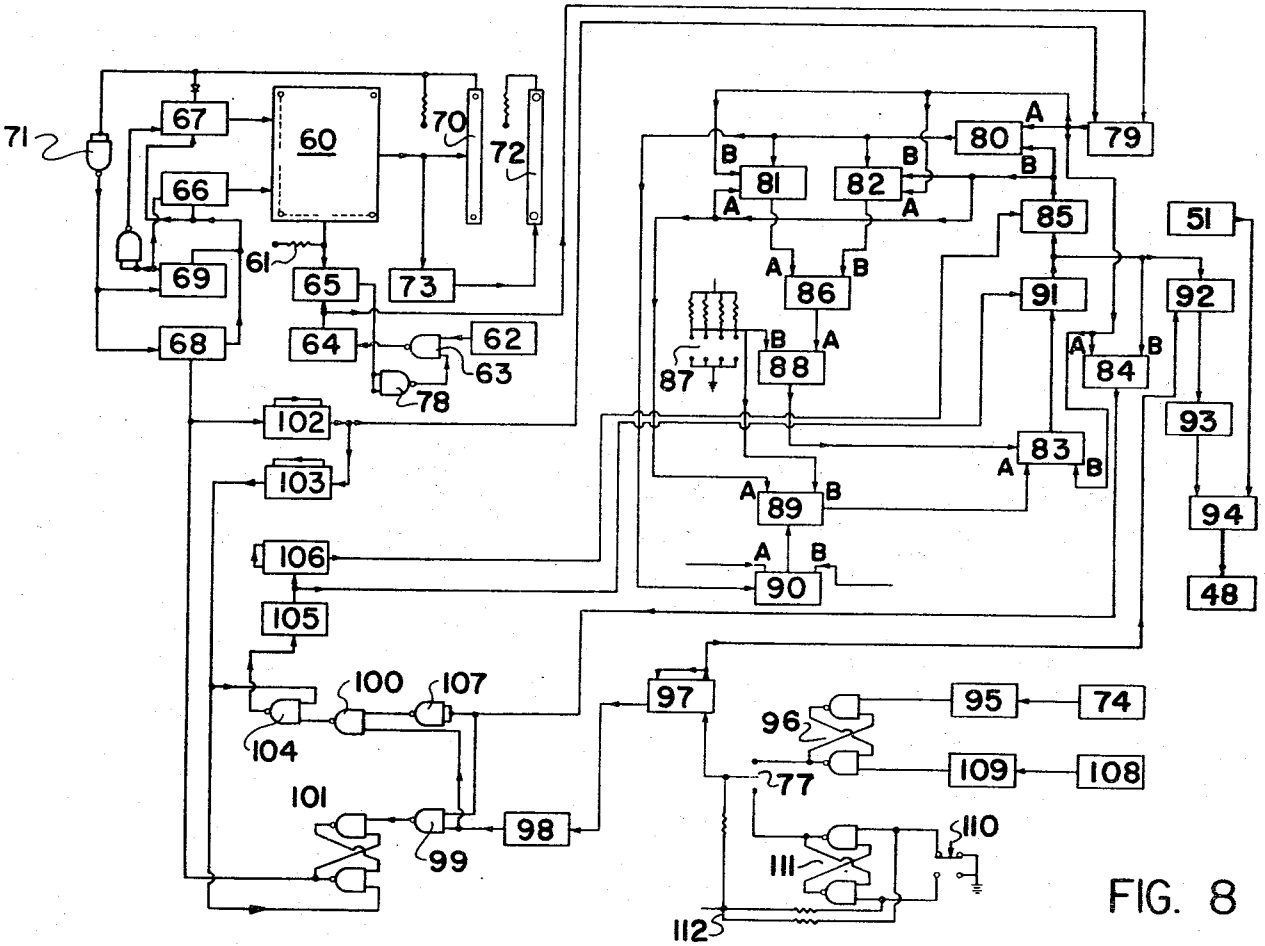
FIG. 8 is a diagram of the electrical circuitry forming the electrical control system for operation of the shifter of FIG. 1.

Automatic control of the above-described hydraulic needle bar shifter 10 is accomplished by electronic circuitry illustrated diagrammatically in FIG. 8 in the form of an electrical control system for generating sequential control signals for commanding the stepwise positioning of the needle bar H of the tufting machine A. Basically, this electrical control system includes means for generating a series of signals of differing magnitude indications, means for selecting a signal from the series, means for comparing the magnitude of the selected signal with the magnitude proportional to the preexisting position of the spool 40 to determine the difference between these magnitudes, means comparing the magnitude difference with a preset maximum magnitude difference, means utilizing the lesser of the differences to select either the selected signal or the preexisting signal combined with the preset magnitude difference to produce a resultant control signal.

The means for generating a series of electrical signals includes a pattern plug jack matrix 60 formed of a rectangular matrix of rows and columns of two-terminal telephone-type jacks. Preferably, an even number of columns, such as 16, are provided with each column corresponding to a possible transverse position of the needle bar H, thus providing the same number of positions on each side of a centerline of the needle bar position with respect to the carpet backing C progressing past the needle bar H. The number of jacks in each column is made equal to the total number of stitches in a pattern repeat, as for example 25. Each jack has a first contact connected to the other jacks in the row and a second contact connecting jacks in each column. Each column bus is maintained at logic "high" through a pull-up resistor 61 associated with each column, there being one such resistor for each column, (only one such resistor being shown in FIG. 8 for clarity of illustration) and each row is sequentially brought to logic "low", or scanned, one row per stitch to be tufted. Each jack is capable of receiving a plug of the type containing a diode connected in the forward bias mode, such that when a plug is inserted into a particular jack in a row, the column location of the jack in the row containing the plug when that particular row is scanned will determine a predesignated position signal to which the system reacts to reposition the needle bar H. Thus, a stitch pattern may be established by inserting one plug in each row in a jack corresponding to the desired transverse stitch position to be produced when that particular row is scanned. Thus, the pattern plug board jack matrix 60 provides for predesignating the signals to be selected by the control system. The plug diodes are insertable in the matrix with the annode as the column bus and the cathode as the row bus. Further details of the matrix are not included herein as such would be apparent to one skilled in the art.

The generation of signals from the matrix 60 is initiated by a clock signal generated by an asynchronous free-running multivibrator 62 that conditions and delivers a clock signal to a first input of a two-input NAND gate 63. The second input to this NAND gate 63 is held at logic "high", with the output complimenting the clock signal, while if the second input is held "low" the output will be "high" and remain "high", ignoring the clock input. The output from the NAND gate 63 is applied to the input of a binary ripple counter 64, the output of which is applied to the address inputs of a data selector 65 and, as is described hereinbelow, forms the output from the plug board matrix 60. The data inputs to the selector 65 are the column buses of the plug board matrix 60, in numerical sequence. At any particular time, the ouptut of the data selector 65 is the compliment of whatever signal is on the particular data input, or column bus, being addressed at that time. Since these addresses are derived from the sequential count of the clock pulses, from zero to the total number of columns and then repeated, each column in the row being scanned is addressed at a rate equal to the clock frequency.

Each row bus in the plug board matrix 60 is connected to the corresponding output line of a two-stage data distributor 66 and 67, having a number of output lines equal to the number of rows on the plug board matrix. The row address input to the distributor 66, 67 is a binary number from zero to the maximum number of rows in the plug board matrix 60. This binary number is the output of a two stage counter 68 and 69, which counts from one up to the maximum number of rows in the peg board matrix 60, or repeats after a lesser number of rows have been scanned as controlled by insertion of a plug in a jack board 70 that has jacks corresponding to the number of rows and receives a signal from the matrix 60 indicating the row being scanned such that when a plug is in the repeat jack board 70 corresponding to a preselected row, a signal is emitted from the repeat jack board 70 through a gate 71 to reset the two stage counter 19, 20. Also associated with the column signal from the plug board matrix 60 is a panel 72 of light emitting diodes corresponding in number to the number of columns and being energized through a buffer 73 to emit a light signal indicating which column is being scanned at any particular time.

The input to the two stage counter 68, 69 originates as a pulse from a first proximity switch 74 disposed adjacent an end of the drive shaft M of the machine A for response to a magnetic element 75 mounted on the periphery of a disk 76 that is fixed for rotation on the shaft M, thereby creating a pulse from the proximity switch 74 once during each revolution of the shaft M at a time in the cycle to initiate needle bar shifting under the control of the electrical control system when the needles G are in that portion of the cycle in which they are out of the carpet backing C and can be shifted without interference therewith. The pulse circuitry between the proximity switch 74 and the counter 68, 69 is described in detail herein below. This signal acting through the counter 68, 69 causes each row of jacks in the plug board matrix 60 to be addressed sequentially with the data distributor 66, 67 bringing the bus of the addressed row to logic "low". The data selector 65 sequentially scans each column bus at the frequency developed by the multivibrator 62 and delivers at its output the compliment of the signal existing on each column bus sequentially. If a column bus being scanned does not contain a plug in the row being held "low" by the data distributor 66, 67, the data input to the data selector 65 from the column being scanned at that instant will be "high" through the pull-up resistor 61 associated with that particular column. In this circumstance, the data selector 65 delivers a "low" to its output, which signal is inverted by a second NAND gate 78 and delivered as a "high" to a second input of the aforementioned NAND gate 63, which as previously mentioned has as its first input the series of clock pulses. The output of the NAND gate 63 compliments the clock output delivering these pulses to the counter 64, which thereupon continues to sequentially address the data selector 65, thereby continuing uninterrupted scanning of each column bus. It, however, a plug containing a properly polarized diode to prevent possible interaction with other jacks has been inserted into a jack in the row being held "low" by the data distributor 66, 67, at the particular instant the column containing this jack is being scanned by the data selector 65, this particular column bus will be "low" having been brought "low" through the diode within the plug and the data distributor 66, 67, the previously existing "high" having been dropped to "low" across the pull-up resistor 61 associated with the particular column. The output of the data selector 65, being the compliment of the address input, will therefore be "high" and will be inverted to "low" by the NAND gate 78 and applied to the second input of the NAND gate 63, the output of which will remain "high", thereby ceasing to deliver countable input to the counter 64. Thus, although complimentary clock pulses continue to be delivered to the NAND gate 63, the counter 64 will not advance the count and will maintain at its output the binary address existing at the last "high" to "low" transition at its input. This address is also delivered as input to a signal receiving and releasing latch 79. Thus, the control system provides means for selecting a signal that will be applied to the remainder of the system as will now be described.

The signal receiving and releasing latch 79 is enabled from the signal developed by the first proximity switch 74 in a manner to be described hereinafter. If the enabling input to this latch 79 is "high" the selected input signal passes through the latch to its output, and if the enabling input to the latch is "low" the selected signal output is latched to the value of the selected signal input existing at the instant of the transition of the enabling input from "high" to "low". Thus, a signal selected by the action of the counter 64 and data selector 65 will be maintained at the latch 79 until it is enabled and this selected signal will then be passed into the succeeding section of the control system, which includes means for comparing the magnitude of the selected signal with that of the preexisting control signal that operated the shifter in the preceding manipulation.

The selected signal released by the latch 79 is applied to the five following inputs: the A input of a selected signal/preexisting signal magnitude comparator 80, the B input of a high data selector 81; the A input of a low data selector 82; the A input of a resultant control signal selector 83; and the A input of a cycling control comparator 84.

The B input of the selected signal/preexisting signal magnitude comparator 80 is the preexisting control signal that has been latched in the position register 85, in the manner described below. If the A input to the selected signal/preexisting signal magnitude comparator 80 is greater than the B input, the output of this comparator will be "high", and if the A input is equal to or less than the B input the output will be "low". This output is the command input to both the high data selector 81 and the low data selector 82. If this command input is "low", both selectors will deliver their A inputs to their outputs, and if the command signal is "high", both selectors will deliver their B inputs to their outputs. The A input to the high data selector 81 is the preexisting control signal from the position register 85, which is also the signal to the B input of the low data selector 82. Thus, the output of the high data selector 81 will always be the greater of the two inputs to the selected signal/preexisting signal magnitude comparator 80 and the output of the low data selector 82 will always be the lesser of the two inputs to the selected signal/preexisting signal magnitude comparator 80. The output of the high data selector 81 is the A input to an arithmetic logic central processing unit 86 and the output of the low data selector 82 is the B input to the central processing unit 86, which is programmed to determine the difference between A and B in absolute, rather than negative or positive value, and to deliver this difference at its output, thus providing means for comparing the difference in the magnitudes of the previously described selected signal and the magnitude of the preexisting control signal. In this way, the control system has at this point in the circuit determined the difference in absolute magnitude between an electrical representation of the selected position to which the spool 40 is desired to be moved and the electrical representation of the preexisting position of the spool, which difference is an electrical representation of the magnitude of the intended shifting of the spool and corresponding shifting of the needle bar.

This electrical representation is then applied to means for comparing the magnitude difference with a preset maximum difference so that the resulting control signal will only move the spool a distance within selected operating limits. For patterning or non-patterning purposes or to limit the stepwise movement of the needle bar, it may be desirable to set the limits of movement to a particular multiple of the needle gauge from one to the maximum allowable shifting for the particular machine involved. In the embodiment illustrated the maximum stepwise increments may be preset in any one of four stages by the use of a conventional set of jumper switches 87 capable of generating a four-bit binary number by switching the appropriate number of jumpers to ground on the low ends of four pull-ups resistors, the generated number representing the magnitude of the maximum step of which the hydraulic system is capable or in the time allowed by the cycle period or the maximum step to be permitted in the selected pattern design. This generated number signal is the B input of a magnitude difference comparator 88, the A input of which is the output of the aforementioned central processing unit 86. This magnitude difference comparator compares its two outputs and provides an output that is "high" if its A input, the difference between the selected signal and the preexisting signal, is greater than its B input, the preset maximum, and is "low" if its A input is less than or equal to its B input. Thus, this output will provide a command to indicate whether the selected signal is within the preset limits and can be utilized as the control signal or whether the selected signal is beyond the preset range and the control signal should then be the combination of the preset maximum and the preexisting signal. This output is the enabling input of the aforementioned resultant control signal selector 83, the A input of which, as mentioned heretofore, is the selected signal from the signal receiving and releasing latch 79. The B input of this resultant control signal selector 83 is the output of a signal combining central processing unit 89 that supplies the signal corresponding to the combination of the preset maximum and the preexisting signal in addition or subtraction as determined in the manner described as follows. The preexisting control signal from the position register 85 is the A input to this central processing unit 89 and the preset maximum magnitude difference signal from the jumper switches 87 is the B input to this central processing unit 89. These two switches are either added or subtracted in response to an enabling signal received from an add or subtract selector 90 that receives an add instruction logic signal at its A input and a subtract instruction logic signal at its B input. The enabling signal for this add or subtract selector 90 is the output of the aforementioned selected signal/preexisting signal comparator 80, which as indicated heretofore is "high" if the selected signal from the latch 79 is greater than the preexisting control signal from the position register 85 and is "low" if the selected signal is equal to or less than the preexisting control signal. Thus, when the selected signal is less than the preexisting control signal, which means that the control system intends moving the spool and needle bar in one direction, the add or subtract selector 90 will give an add instruction to the central processing unit 84 so that the signal to the resultant control signal selector 83 will be the addition of the preexisting control signal and the preset maximum difference, and if the selected signal is greater than the preexisting control signal, meaning that the control system intends moving the needle bar in the opposite direction, the central processing unit 89 will be instructed to subtract the preset maximum magnitude difference from the preexisting control signal in providing the input to the resultant control signal selector 83. The output of the resultant control signal selector 83 is the new control signal that will become the preexisting control signal for the next cycle of operation of the electrical system and this new control signal is the input to a settling latch 91 that retains the signal before releasing it to the position register 85 so that the new control signal will not be imposed on the position register 85 until after the position register has closed following the above-described operation of the control system in the current cycle. The output of the settling latch 91 is also applied to a command latch 92 that retains the control signal for timed release as will be described. The control signal as released from the command latch 92 is the input to a digital-to-analog converter 93 that transforms the control signal to a command analog signal that is one input to a split phase amplifier 94 that responds to the command analog signal in comparison with the signal from the previously described transducer 51 to provide the command control signal for operation of the servo valve 48 that manipulates the control spool 40 which is followed in movement by the operating rod 27 and attached needle bar H.

The cycling of the above-described electrical control system is controlled by the output of the cycling control comparator 84, which allows the cycling initiated by the aforementioned first proximity switch 74 to index the signal generating means when the inputs to the cycling control comparator 84 are identical, meaning that the selected signal becomes the control signal and that it is within the preset magnitude difference causing movement of the plug 40 and needle bar H to a position corresponding to the selected signal. On the other hand, the cycling control comparator 84 functions to prevent indexing of the signal generating means when the inputs to this comparator are different, indicating that the selected signal is beyond the preset maximum difference from the preexisting control signal, thereby requiring more than one step advance of the system, during which no signal generating indexing is to occur, for the system to advance the spool 40 and following needle bar H to the position indicated by the selected signal.

In the cycling operation of the system, the first proximity switch 74 is responsive to the magnetic element 75 as it rotates past the switch during each rotation of the drive shaft M in which the needles are inserted and retracted from the backing fabric to form tufting loops. This signal from the proximity switch is cleaned through a pulse conditioner 95 and passes through a bistable RS flipflop 96, the output of which passes through an automatic/manual selector switch 77 to a first timer 97, which triggers on the negative-going edge of the applied pulse, and delivers a positive output pulse that is the enabling input of the aforementioned command latch 92 that causes the latch to release the latched control signal previously determined by the system for activation, through the converter 93 and amplifier 94, of the servo valve 48 to step the spool 40 and following needle bar H. A delayed output of the first timer 97 is the input of a second timer 98 that delays the pulse sufficiently to assure functioning release of the control signal from the command latch 92 before the control system redetermines the next control signal. The output from this second timer 98 is the input to each of two NAND gates 99 and 100. The second input to the first NAND gate 99 is the "high" output from the cycling control comparator 84, signaling that the control signal is the same as the selected signal so that indexing of the signal generating means should occur for selection of the next selected signal. The output of the first NAND gate 99 is the compliment of the delayed output of the second timer 98 and is used to set a bistable RS flipflop 101. The output of this flipflop is "low" and remains low until reset, as will be described below. This low output serves as the strobe pulse input to the two stage counter 68, 69 that results in indexing of the row scan on the jack matrix 60. The output of the second timer 98 is also used as the input of a third timer 102, which provides sufficient time delay to allow the strobed row scan of the matrix 60 and the selecting of a scanned signal to settle and be applied to the input to the signal receiving and releasing latch 79. The output of the third timer 102 is a positive pulse, and on its trailing edge causes the transition of the output from "low" to "high". The "high" output opens the signal receiving and releasing latch 79, allowing the newly selected signal to enter the latch. When the output of the third timer 102 times out, it returns to "low", thus relatching the latch 79 with the new selected signal on the latch output.

The output of the third timer 102 is also the input to a fourth timer 103, the output of which goes "low+ and returns to "high" when the output times out. This output pulse of the fourth timer 103 is the resetting input of the aforementioned flip-flop 101 that receives the signal from the second timer 98. This output from the fourth timer 103 also is the first input to a third NAND gate 104, the second input to which is the output of the second NAND gate 100. As mentioned above, the first input to this second NAND gate 100 is the output of the second timer 98 that had been triggered by the proximity switch pulse. The second input to this second NAND gate 100 is the compliment of the output of the aforementioned cycling control comparator 84. This compliment will be "low" so long as the output of the comparator is "high", signaling that the control signal is within the range to be completed in one step. The output of the second NAND gate 100 therefore remains "high", ignoring the pulse on the input from the second timer 98. The output from the third NAND gate 104, with both its inputs "high", is "low", but when the "high" signal on the output of the fourth timer 103 goes "low" to reset the flipflop 101, the output of the third NAND gate 104 goes "high" for the duration of the "low" on the timed output of the fourth timer 103. Upon returning to "low", the output of the third NAND gate 104 triggers the input to a fifth timer 105, whose output thereupon is the enabling input to the settling latch 91, admitting the new control signal to the latch and relatching when the timer output times out. At this time, the output also triggers the input to a sixth timer 106, whose output opens the aforementioned position register 85 and relatches it when the timer output times out, thereby holding the new control signal for subsequent comparison with the next selected signal.

The above-described cycling process repeats as along as a row scan results in a selected signal that is within the preset magnitude difference from the preexisting control signal. Should the cycling control comparator 84 determine that the selected signal is different from the control signal determined by the system, indicating that at least one more step is necessary to reach the selected signal position before again indexing the row scan, the output of the cycling control comparator 84 will be "low", preventing the pulse from the output of the second timer 98 from setting the flipflop 101, thereby withholding the strobe pulse which otherwise would advance the row count to the next row of the matrix 60 and maintains the signal receiving and releasing latch 79 closed to maintain the previously selected signal for comparison in the next cycle of the system. Preventing resetting of the flipflop 101 also results in the output of the fourth timer 103 remaining at its "high". However, with the output of the cycling control comparator 84 "low", its compliment through the reversing element 107 to the second NAND gate 100 is "high" so that when the pulse from the output of the second timer 98 goes to "high" on the second NAND gate 100, the output of the second NAND gate goes "low", driving the output of the third NAND gate 104 "high" for the duration of the pulse from the second timer 98. Upon returning to "low", the input of the fifth timer 105 is triggered, and the operation of the settling latch 91 and position register 85 functions as described previously. Thus, if a plug position on the matrix 60 indicates a shift in either direction greater than the predetermined maximum, row scanning will stop, and only maximum permissible, or lastly less than maximum if necessary, shifts in the proper direction will be commanded until the excessively spaced position is reached, at which time row scanning will begin again.

If by mistake, more than one plug is inserted in one row of the matrix 60, the electrical system will select only one plug and ignore the other in advancing to the next row. This occurs as follows. The multivibrator 62, as indicated above, provides a continuing series of pulses as input to the ripple counter 64, whose output addresses to the data selector 65 sequential count corresponding to each column in the matrix. When a column thus addressed is found to be at logic "low" due to the presence of a plug in that column, the output of the selector 65 interrupts the count input to the counter 64 and the count output of the counter holds. When the next row strobe pulse arrives, advancing the row scan one step, if a plug is in the same column as in the previous row, the counter will still hold. If, however, no plug is in the newly scanned row in the same column as in the previously scanned row, the counter will restart at one count above the count at which it had stopped, counting at the multivibrator frequency to the last column, if necessary, and then returning to the first column until a column is found at logic "low", due to the presence of a plug in that column of the row being scanned, at which time, the count will again be interrupted. Thus, in the case of multiple plugs inserted into jacks in one row, the column selected will be the one containing the plug which is next in the count sequence to the plug position in the row just previously scanned, and all other plugs will be ignored.

If no plug is inserted into any jack in a row, the scanning of that row will result in an unpredictably randomly selected signal. As previously noted, the output of the flipflop 101 that receives the pulse from the first proximity switch 74, when "set" by the pulse through the first NAND gate 99, strobes the row counter 68, 69, advancing the row scan one row. If the row then being scanned contains no plug at all, the counter 64 will be reactivated and cause the data selector 65 to scan all columns at the clock frequency of the multivibrator 62. However, all column buses will be "high" due to the absence of a plug in the row and column scanning will continue, repeating scanning of the same row when the count reaches the last column. As previously mentioned, the strobe pulse also triggers the input to the third timer 102, whose output goes "high", opening the signal receiving and releasing latch 79 and holding it open until the timer times out and goes "low". The signal latched by the latch 79 will be the output of the counter 64 existing at the input of the latch 79 at some instant during the transition of the latch command signal from the third timer 102 for "high" to "low". As the vibrator 62 is independent of the cycling of the stitch action of the machine A, the clock frequency of the counter 64 is asynchronous. Also, the clock frequency of the multivibrator 62 is substantially greater than the frequency of rotation of the drive shaft M that creates the proximity switch strobing frequency, which assures random selection of the signal to serve as the selected signal at the signal receiving and releasing latch 79. In a typical installation, the machine A may be run at an optimum rate of as much as 600 stitches per minute, which would produce a probing proximity switch frequency of ten hertz, whereas the multivibrator 62 would operate at a frequency of, for example, 15 kilocycles, which is 15,000 hertz. This results in a relation of the cycles of one cycle of the signal receiving and releasing latch 79 to 1,500 cycles of the signal selection scanning. For a 16 plug row in the matrix 60, this would mean that there would be an average of 93.75 scans of a 16 plug row for each cycle of actuation of the latch 79 such that the latching of a signal would be truly unpredictably random as the period of cycling actuation of the signal receiving and releasing latch is sufficiently imprecise in relation to the high frequency of scanning to vary over a range greater than a plurality of periods of the scanning frequency such that the scan signal at the instant of actuation to release a signal is an unpredictably randomly selected signal.

When it is desired to provide a totally random distribution of the sequence of needle positions, all plugs can be removed from the matrix 60. It should be noted that the previously described limiting movement within preset magnitude differences and continued movement until a selected signal is reached will be operable as well in the random system as the signal that is randomly selected may be outside the present maximum range and, if so, it will be retained as the selected signal until the system steps to it in the same manner as described in the condition when a plug predesignates the selected signal.

The electrical control system includes means to prevent an inadvertent pulsing as the machine is stopped, which could occur if the magnetic element 75 on the drive shaft disk 76 happens to move reversely slightly past the first proximity switch 74 as a reaction to stopping, such as could occur when stopping occurs when the weight of the needle bar H is raised with the eccentrics L in an offset position, thereby applying a reverse rotation force to the shaft M. Such inadvertent indexing is prevented by providing a second proximity switch 108 located at an arcuate spacing from the first proximity switch 74 for response to the same magnetic element 75. The pulse from this second proximity switch 108 is cleaned by a second pulse conditioner 109 and provides the reset input to the aforementioned flipflop 96. Thus, when the magnetic element 75 has passed the first proximity switch 74 and caused indexing, the flipflop 96 will prevent a second pulse to pass until the magnetic element 75 has passed the second proximity switch 108 to reset the flipflop 96. The spacing between the proximity switches can be such that inadvertent incremental backup and second energizing of the first proximity switch cannot occur.

The control system provides means for stepping the machine manually by switching the aforementioned selector switch 77 from its automatic mode contact to its manual mode contact and then depressing the manual switch 110 which acts through a flipflop 111 to jog the system. A resistor circuit 112 is included in the manual jogging circuit to protect the system during transition from automatic to manual operation.

Figure 9:
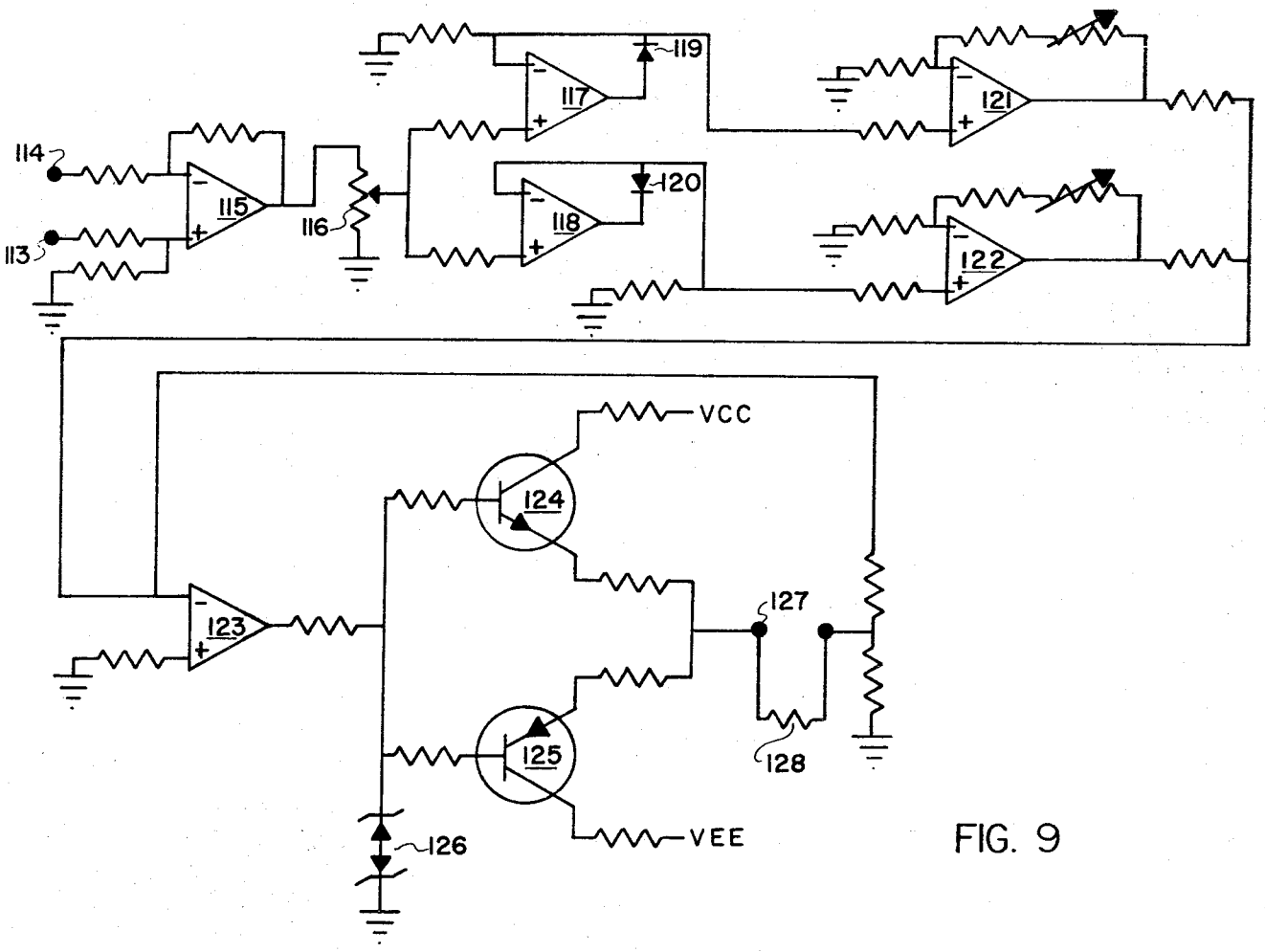
FIG. 9 is an electrical diagram of the split phase amplifier incorporated in the electrical control sytem of the preferred embodiment of the needle bar shifter of the present invention.

As indicated previously, the control signal released by the command latch 92 provides the input to the digital-to-analog convertor 93 that includes a selector to select one of a number of preset binary numbers, one for each column on the pegboard, which when selected in response to the control signal is converted by the convertor 93 to produce a direct current analog signal that is the command input to the aforementioned split phase amplifier 95, the other input to which is the signal from the transducer 51 corresponding in analog magnitude to the existing position of the aforementioned control spool 40. The circuitry of the amplifier 94 is shown in FIG. 9, in which it is seen that the command signal from the convertor 93 is delivered to the non-inverting input 113, and the signal from the transducer 51 is delivered to the inverting input 114. These inputs are directed to an operational amplifier 115, the output of which represents the algebraic difference between the two inputs, of positive polarity if the inverting input is smaller than the non-inverting input or of negative polarity if the inverting input is larger than the non-inverting input. This output passes through a gain control 116 to the input of two similar but oppositely polarized amplifiers 117 and 118, each of which includes a diode 119, 120 in its output with the diodes of the amplifiers 117 and 118 being reversed so that one amplifier 117 responds to input signals of only positive polarity and the other amplifier 118 responds to input signals of only negative polarity. The output of each of these single polarity output amplifiers 117 and 118 is the input to a gain control amplifier 121 and 122 that permits individual adjustment of the gain of the positive and negative signals so that the signals can be individually amplified in magnitude independently of the magnitude of the signal of opposite polarity. The outputs from these gain control amplifiers 121 and 122 are joined to form a single output as there will only be one polarity signal passing through the circuitry at one time, with the polarity of that single signal being determined by the operational amplifier 115. This output from the gain control amplifiers 121 and 122 provides the input to an inverting amplifier 123 that feeds to two power amplifiers 124 and 125, which are complimentary symmetrical amplifiers, each transmitting a signal of only one polarity with the amplitude of the signal being limited by zener diodes 126. The output of the power amplifiers 124 and 125 is applied to the input 127 to the coil 128 of the servo valve 48. As the direction of motion of the spool 40 effected by the servo valve 48 is determined by the polarity of the signals to the servo valve coil 128, separate adjustments of gain for each polarity by the split phase amplifier 94 as herein described, permits different levels of excitation to the servo valve for each direction of motion, thereby allowing optimization of the speed of operation by compensating for differences in forces and rates of fluid flow due to the ratio of effective areas of the two sides of the operating rod piston 29, the complex flow and pressure relationships in the system otherwise, and differences in inertia and other resistance to motion in the operating rod 27 and needle bar H operated thereby.

In operation, the system is programmed by predesignating the signals to be selected by placing plugs in the matrix 60 to provide a desired pattern or a non-streaking positioning sequence or plugs can be omitted to obtain an unpredictably random sequence of needle positions. Also, a plug can be inserted in the repeat panel 72 to program the number of rows in each repeating sequence, or no plug can be placed in the panel 72 so that the sequence will progress through all of the rows of the matrix 60 before repeating. The jumper switches 87 are then set as desired to provide the limit of the transverse stepping of the needle bar during each cycle, which effects the pattern and also importantly can be used to be sure that no greater transverse movement will occur than can be done during the time that the needles G are out of the fabric during each cycle of the operation of the machine, which available time is, of course, dependent on the stitches per second at which the machine is operating.

After setting the plug pattern in the matrix and the jumper switch selection for determining the preset maximum magnitude, the system is then actuated by manipulating the switch 110 to set the control system on automatic operation, following which the electrical system will function on each revolution of the drive shaft M to produce a control signal that is applied to excite the servo valve 48 to result in mainpulation of the operating rod 27 and attached needle bar H until the signal from the transducer 51 equals the control signal, indicating that the spool 40 has reached the selected position, which equality of signals will result in no signal being passed through the split phase amplifier 94 to the servo valve 48, the excitation of which thereby stops and the spool is maintained in the new position to which the hydraulic system causes the operating rod 27 and needle bar H to move in following relation with rapid and precise needle gauge spacing positioning.

In a typical operation, the machine A could be operating at as much as 600 stitches per minute, which is faster than normally considered practically possible with prior art needle bar shifters and shifting of the needle bar at least three-eighths inches in either direction in each cycle is possible, with the hydraulic system for manipulating the operating rod being under 1,200 psi pressure. The high pressure operation and the precise and rapid positioning is obtained as a result of the mechanical design and electrical system, particularly because the control spool 40 is hydraulically balanced and of relatively small mass in comparison with the operating rod 27 and needle bar H such that the spool can be rapidly and precisely shifted with a small force over a sufficient range of needle gauge lengths to permit a wide range of pattern possibilities.

It should be understood that the foregoing detailed description is of the preferred embodiment of the present invention and various modifications and alternative constructions could be utilized within the scope of the present invention. For example, the control signal could be applied to a stepper motor drive or to a multiple piston drive of binarily quantsized stroke lengths or by other means. Stepper motors tend to be slower acting than servo valves and multiple position drives have limited positioning capabilities, but either could be used under suitable circumstances. Because of the fast response, the utilization with a large variety of pattern possibilities, and simplicity of operation of small servo valves, the presently preferred embodiment utilizes a servo valve in the manner described in detail hereinabove.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. A needle bar shifter for selectively positioning a transversely slidable needle bar of a textile turting machine comprising a housing mounted on said machine, an operating rod reciprocally mounted in and projecting from said housing for transverse movement in alignment with and connected to said slidable needle bar for transverse positioning thereof, said housing having a linearly extending piston chamber in which said operating rod reciprocates and a return chamber separate from said piston chamber through which said operating rod reciprocates, an intake port formed in said housing and communicating with said piston chamber for introduction of pressurized hydraulic fluid thereinto and a discharge port formed in said housing and communicating with said return chamber for discharge of hydraulic fluid therefrom, said operating rod having a piston formed thereon in said piston chamber in sealing disposition for reciprocation therein at a spacing from said intake port, said operating rod having a linearly extending bore therein opening into the portion of said piston chamber opposite said intake port and communicating with said return chamber, a control spool sealingly disposed in said bore for sliding therein, said operating rod having a drive passage therethrough for passage of pressurized hydraulic fluid from the portion into which said intake port opens to said opposite portion to drive said piston in a direction to expand said opposite portion, one of said operating rod and said control spool having a return passage therein opening into and extending between said bore and said opposite portion of said piston chamber for flow of hydraulic fluid to said return chamber upon movement of said piston in a direction to contract said opposite portion, said spool being selectively positionable in closing relation to either one or both passages to selectively permit flow of hydraulic fluid through one or the other or neither of said passages, said piston having an effective surface area in said opposite portion of said piston chamber for application of pressurized hydraulic fluid to cause piston movement in the direction of said intake port sufficiently larger than the effective surface area in said intake port portion so that upon movement of said spool from a disposition closing both passages in a direction to open said drive passage the pressurized hydraulic fluid passing therethrough will act on said piston to move said operating rod into passage closing relation to said spool and upon movement of said spool in the opposite direction said return passage will be opened allowing fluid to pass from said opposite portion of said piston chamber to said return chamber and thereby allowing the pressurized fluid in said intake port portion to move said operating rod in the opposite direction into passage closing relation to said spool, and means for selectively positioning said spool to open one or the other of said passages and thereby cause responsive movement of said operating rod by unbalanced application of pressurized hydraulic fluid to said piston with a corresponding movement of said needle bar.

2. A needle bar shifter according to claim 1 and characterized further in that said spool is disposed in relation to said operating rod to be positionable to simultaneously close both passages with slight movement of said spool in one direction or the other causing opening of one passage or the other.

3. A needle bar shifter according to claim 2 and characterized further in that at least one of said operating rod and spool are tapered at a location adjacent the passage in the other when both said passages are closed, thereby causing gradual decelerating relative movement of the operating rod as it approaches a position in which both passages are closed.

4. A needle bar shifter according to claim 1 and characterized further in that both said passages are formed in said operating rod.

5. A needle bar shifter according to claim 4 and characterized further in that both said passages have openings into said bore with said spool being selectively positionable within said bore to close one or the other or both said openings.

6. A needle bar shifter according to claim 5 and characterized further in that said return passage opening in said bore is spaced from said drive passage opening in said bore in the direction of operating rod movement during expansion of said other portion of said piston chamber, and said spool is maintained with a portion in bore closing disposition between said openings in all selected spool positions to thereby prevent communication between said openings.

7. A needle bar shifter according to claim 6 and characterized further in that said spool extends linearly within said bore a length sufficiently to be positionable to simultaneously cover both passage openings with slight movement of said spool in one direction or the other uncovering one opening or the other.

8. A needle bar shifter according to claim 5, 6 or 7 and characterized further in that said spool is tapered away from a closing relation to said openings adjacently beyond said openings when both openings are closed by said spool, said taper causing gradual deceleration of relative movement of the operating rod as it approaches a position in which both openings are covered by said spool.

9. A needle bar shifter according to claims 1, 4 or 7 and characterized further in that said control spool extends through and exteriorly beyond said opposite portion of said piston chamber and the effective surface area of said control spool within said opposite portion is substantially balanced so that said spool is substantially uneffected by the pressure of the hydraulic fluid in said opposite portion, and said means for selectively positioning said spool is also disposed exteriorly of said opposite portion.

10. A needle bar shifter according to claim 9 and characterized further in that said means for selectively positioning said spool comprises a spool positioning chamber formed in said housing and in which said spool extends, a piston formed on said spool and disposed for reciprocation in said spool positioning chamber, and means for selectively applying hydraulic fluid to opposite sides of said spool piston to cause selective positioning of said spool in said piston chamber.

11. A needle bar shifter according to claim 10 and characterized further in that said means for selectively applying hydraulic fluid comprises a servovalve.

12. A needle bar shifter according to claim 11 and characterized further in that said means for selectively positioning said spool includes means for selecting a position toward which said spool is to move and means to limit the extent of each movement of said spool to a predetermined distance from the position to which it was previously moved.

13. A needle bar shifter according to claim 12 and characterized further in that said means for selecting a position randomly selects said position.

14. A needle bar shifter according to claim 12 or 13 and characterized further in that in response to limited movement of said spool to a position spaced from said selected position said means for selectively positioning said spool subsequently repositions said spool toward said selected position and said means for selecting a position remains inactive until said spool has made sufficient movements to have moved to the selected position.

15. An electrical control system for generating sequential control signals for commanding the stepwise positioning of an object comprising means for generating a series of electrical signals providing differing magnitude indications proportional to stepwise positions of said object, means selecting a signal from said series, means comparing the magnitude indicated by said selected signal with the magnitude of a pre-existing signal whose magnitude is proportional to the pre-existing position of said object to determine the difference between said magnitudes, means comparing said magnitude difference with a preset maximum magnitude difference, means utilizing the lesser of said differences to select, respectively, either the selected signal or the pre-existing signal combined with the preset maximum magnitude difference, to produce a resulatant control signal, means responsive to said resultant control signal to position an object in proportion to the magnitude of said resultant control signal as limited, means responsive to the magnitude indicated by said selected signal being different from the magnitude of said resultant control signal to interrupt said signal selecting means and thereby maintain said selected signal for processing in said control system as the next selected signal.

16. An electrical control system according to claim 15 and characterized further in that said signal magnitude comparing means determines the absolute value of said magnitude difference and determines whether the magnitude of said selected signal is greater or lesser than the magnitude of said preexisting control signal, and said magnitude difference comparing means compares said absolute value with said preset maximum magnitude difference and said magnitude difference utilizing means combines said preexisting signal with said preset magnitude difference by addition or subtraction in response to said greater or lesser determination, respectively, by said signal magnitude comparing means.

17. An electrical control system according to claim 15 and characterized further by means for cycling said control system by periodically releasing the preexisting control signal for comparison with said selected signal by said magnitude comparing means.

18. An electrical control system according to claim 17 and characterized further in that said means for cycling is responsive to movement of said object.

19. An electrical control system according to claim 18 and characterized further in that said object includes a rotating shaft and said means for cycling is responsive to rotation of said shaft.

20. An electrical control system according to claim 17 and characterized further in that said means for generating a series of electrical signals generates a plurality of series of signals sequentially, and said cycling means actuates said signal generating means to index from one series of signals to the next in response to the magnitude of said selected signal being the same as the magnitude of said resultant control signal.

21. An electrical control system according to claim 17 and characterized further in that said means for generating a series of electrical signals includes means permitting predesignating of the signal to be selected by said signal selecting means.

22. An electrical control system according to claim 17 and characterized further in that said means for generating a series of electrical signals generates a plurality of series of signals sequentially and includes means permitting predesignating of the signal to be selected in each series, and said cycling means activates said signal generating means to sequentially index from one series of signals to the next.

23. An electrical control system according to claim 22 and characterized further in that said cycling means actuates said signal generating means to index from one series to the next in response to the magnitude of said selected signal being the same as the magnitude of said resultant control signal.

24. An electrical control system according to claim 21 and characterized further in that said means for generating a series of signals includes means for scanning the signals in each series and in response to scanning of the predesignated signal interrupting said scanning and thereby maintaining said predesignated signal as the selected signal for comparing by said magnitude comparing means until said cycling means activates said signal generating means to index to the next series of signals.

25. An electrical control system according to claim 24 and characterized further in that said signal selecting means includes means for receiving signals from said signal scanning means and for releasing scanned signals to said signal magnitude comparing means in response to actuation by said cycling means, the frequency of scanning by said signal scanning means being sufficiently greater than the frequency of said cycling means so that a predesignated signal will be selected and will be received and maintained by said signal releasing means for release upon actuation by said cycling means.

26. An electrical control system according to claim 25 and characterized further in that the period of cycling actuation of said signal releasing means by said cycling means is sufficiently imprecise in relation to the frequency of scanning to vary over a range greater than a plurality of periods of the scanning frequency whereby when no signal has been predesignated and the scanning is continuing uninterrupted the signal at said signal releasing means at the instant of actuation to release a signal is an unpredictably randomly selected signal.

27. An electrical control system according to claim 26 and characterized further in that said signal scanning means includes sequencing means for operating said scanning means at a frequency independent of said cycling means.

28. An electrical control system according to claim 27 and characterized further in that said means for cycling is responsive to movement of said object and said sequencing means operates independently of movement of said object.

29. An electrical control system according to claim 28 and characterized further in that said object includes a rotating shaft and said means for cycling is responsive to rotation of said shaft.

30. An electrical control system according to any of claims 15–29 and characterized further in that said object being stepwise positioned by control signals generated by said electrical control system is a transversely slidable needle bar of a textile tufting machine and said stepwise positioning is in increments equivalent to one or a plurality of needle spacings of said needle bar, and said preset maximum magnitude difference is equivalent to one or a plurality of needle spaces.

31. An electrical control system for generating sequential control signals comprising means for generating a series of electrical signals of varying magnitude and including means for scanning said signals, means for selecting a signal from said scanned signals including means for receiving signals from said signal scanning means and for releasing scanned signals, means for periodically cycling said control system to actuate release of a scanned signal by said signal receiving and releasing means, means responsive to said released scanned signal to produce a resultant control signal, the period of cycling actuation of said signal receiving and releasing means by said cycling means being sufficiently imprecise in relation to the frequency of scanning to vary over a range greater than a plurality of periods of the scanning frequency whereby the scanned signal at said signal receiving and releasing means at the instant of actuation to release a signal is an unpredictably randomly selected signal.

32. An electrical control system according to claim 31 and characterized further in that said signal scanning means includes sequencing means for operating said scanning means at a frequency independent of said cycling means.

33. An electrical control system according to claim 32 and characterized further by means responsive to said resultant control signal to position an object in proportion to the magnitude of said resultant control signal, and in that said means for cycling is responsive to movement of said object and said sequencing means operates independently of movement of said object.

34. An electrical control system according to claim 33 and characterized further in that said object includes a rotating shaft and said means for cycling is responsive to rotation of said shaft.

35. An electrical control system according to claim 31 and characterized further in that said means for generating a series of electrical signals generates a plurality of series of signals sequentially for scanning, said cycling means actuates said signal generating means to index from one series of signals to the next, and said signal generating means includes means permitting predesignating of a signal to be selected in each series with said signal receiving and releasing means receiving and releasing said predesignated signals when in a scanned series instead of an unpredictably randomly selected signal.

36. An electrical control system according to claim 31 and characterized further by means for limiting the magnitude of said resulting control signal to either the magnitude of said selected signal or the magnitude that is a predetermined difference from the magnitude of the preceding control signal, whichever magnitude differs the least from the preceding control signal.

37. An electrical control system according to any of claims 31, 32, 35 or 36 and characterized further by means responsive to said resultant control signal to position a transversely slidable needle bar of a textile tufting machine in increments equivalent to one or a plurality of needle spacings of said needle bar, and said cycling means is responsive to rotation of the needle bar operating shaft of said tufting machine.

* * * * *

UNITED STATES PATENT OFFICE

CERTIFICATE OF CORRECTION

Patent No. 4,483,260 Dated November 20, 1984

Inventor(s) Donald A. Gallant

It is certified that error appears in the above-identified patent and that said Letters Patent are hereby corrected as shown below:

Column 6, line 37, delete "3" and insert therefor --13-- .
Column 8, line 48, delete "an" and insert therefor --and-- .
Column 11, line 7, after "plug" insert --board-- .
Column 12, line 57, delete "It" and insert therefor --If-- .
Column 14, line 56, delete "switches" and insert therefor --signals-- .
Column 16, line 30, delete "The" and insert therefor --This-- .
Column 16, line 37, delete "low+" and insert therefor --low-- .
Column 16, line 40, delete "flip-flop" and insert therefor --flipflop-- .
Column 18, line 20, delete "for" and insert therefor --from-- .
Column 18, line 55, delete "present" and insert therefor --preset-- .
Column 19, line 31, delete "95" and insert therefor --94-- .
Column 20, line 42, delete "mainpulation" and insert therefor --manipulation-- .
Column 21, line 25, delete "turting" and insert therefor --tufting-- .
Column 23, line 48, delete "resulatant" and insert therefor --resultant-- .

Signed and Sealed this

*Twenty-fourth* Day of *December 1985*

[SEAL]

*Attest:*

DONALD J. QUIGG

*Attesting Officer*

*Commissioner of Patents and Trademarks*